US006825427B2

(12) United States Patent
Jenks

(10) Patent No.: US 6,825,427 B2
(45) Date of Patent: Nov. 30, 2004

(54) ELECTRICAL INTERRUPT SWITCH

(76) Inventor: Jerry A. Jenks, P.O. Box 6, Premier, WV (US) 24878

( * ) Notice: Subject to any disclaimer, the term of this patent is extended or adjusted under 35 U.S.C. 154(b) by 424 days.

(21) Appl. No.: 09/833,978

(22) Filed: Apr. 12, 2001

(65) Prior Publication Data

US 2002/0055306 A1 May 9, 2002

Related U.S. Application Data

(60) Provisional application No. 60/196,859, filed on Apr. 12, 2000.

(51) Int. Cl.[7] ..... H01R 13/71

(52) U.S. Cl. ..... 200/51.12; 200/562; 439/651

(58) Field of Search ..... 439/651; 200/51 R, 200/339, 562, 563, 51.12

(56) References Cited

U.S. PATENT DOCUMENTS 2,484,092 A * 10/1949 Hopgood ..... 439/651
2,706,225 A * 4/1955 Freeman ..... 439/651
3,974,347 A * 8/1976 Lockard ..... 200/339
4,463,228 A * 7/1984 Osika ..... 200/51 R

* cited by examiner

*Primary Examiner*—Renee Luebke
(74) *Attorney, Agent, or Firm*—John D. Gugliotta; P. Jeff Martin; Olen L. York, III

(57) ABSTRACT

An electrical circuit interrupter for a conventional electrical plug is provided that be mounted on a wall electrical socket or on the plug itself. Adaptable to either 2-prong or 3-prong electrical plugs, a toggle switch either turns on or off the circuit from the plug to the wall socket.

2 Claims, 3 Drawing Sheets

ELECTRICAL INTERRUPT SWITCH

RELATED APPLICATIONS

The present invention is a continuation of U.S. Provisional Patent No. 60/196,859 filed on Apr. 12, 2000.

BACKGROUND OF THE INVENTION

1. Field of the Invention

The present invention relates generally to electrical switches and, more particularly, to a general purpose, consumer electrical interrupt switch.

2. Description of the Related Art

There are many electrically powered items in our homes and businesses which do not have an on/off switch. These include some kitchen appliances, tools, Christmas lights and the like. There are also some items with power switches that still utilize power when in the off position. These include televisions, computers, VCR's and other electronic items. The only way to completely remove electrical power from all of these devices is to remove the electrical power cord from the receptacle. This however, has several disadvantages. First, the continual wear and tear on the plug and receptacle from repeated insertions may cause either the plug or receptacle to fail prematurely. Secondly, the act of inserting a plug allows for a short time period in which the prongs are energized, but not yet fully inserted. This poses a shock hazard to the user should his or her fingers touch the prongs as may be the case if the receptacle is hidden from view and the user is going by feel alone to find the receptacle.

A search of the prior art did not disclose any patents that read directly on the claims of the instant invention; however, the following references were considered related.

The following patents disclose a modular electrical power outlet system and method for switching circuits:

U.S. Pat. No. 5,844,326 issued in the name of Proctor et al.; and

U.S. Pat. No. 5,582,522 issued in the name of Johnson.

The following patents describe an efficient power supply post regulation with a switching device:

U.S. Pat. No. 5,019,284 issued in the name of Fisher et al.; and

U.S. Pat. No. 5,075,839 issued in the name of Fisher et al.

U.S. Pat. No. 5,959,273 issued in the name of Chou discloses an electrical outlet with press-button switch means.

U.S. Pat. No. 5,925,850 issued in the name of Park describes an electrical outlet, switch, and junction boxes.

U.S. Pat. No. 5,819,912 issued in the name of Hou discloses a slide selector switch and inlet outlet device.

U.S. Pat. No. 5,488,208 issued in the name of Seewald describes a multiple electrical outlet box with locking cover and power interrupt control.

And, U.S. Pat. No. 4,463,228 issued in the name of Osika discloses a portable electrical switch and outlet unit.

Accordingly, there exists a need for a means by which electrical power can be removed completely from equipment in a manner that is safe, quick, easy and effective.

SUMMARY OF THE INVENTION

It is therefore an object of the present invention to provide an improved electrical interrupt switch.

It is a feature of the present invention to provide an improved general purpose, consumer electrical interrupt switch.

Briefly described according to one embodiment of the present invention an electrical circuit interrupter is provided for a conventional electrical plug. The device may be mounted on a wall electrical socket or on the plug itself. The device is adaptable to either 2-prong or 3-prong electrical plugs and is made of plastic or rubber with electrical wire connecting the switch to the prongs. A toggle switch either turns on or off the circuit from the plug to the wall socket.

The major advantage of this device is the toggle switch that interrupts the electrical circuit from a conventional cord to the wall socket. With this invention, one doesn't need to unplug the cord from the wall; one simply switches the device from on to off, thereby connecting or disconnecting power to the cord.

BRIEF DESCRIPTION OF THE DRAWINGS

The advantages and features of the present invention will become better understood with reference to the following more detailed description and claims taken in conjunction with the accompanying drawings, in which like elements are identified with like symbols, and in which:

DESCRIPTION OF THE PREFERRED EMBODIMENTS

The best mode for carrying out the invention is presented in terms of its preferred embodiment, herein depicted within the FIGS. 1 through 4.

1. Detailed Description of the Figures

Figure 1:
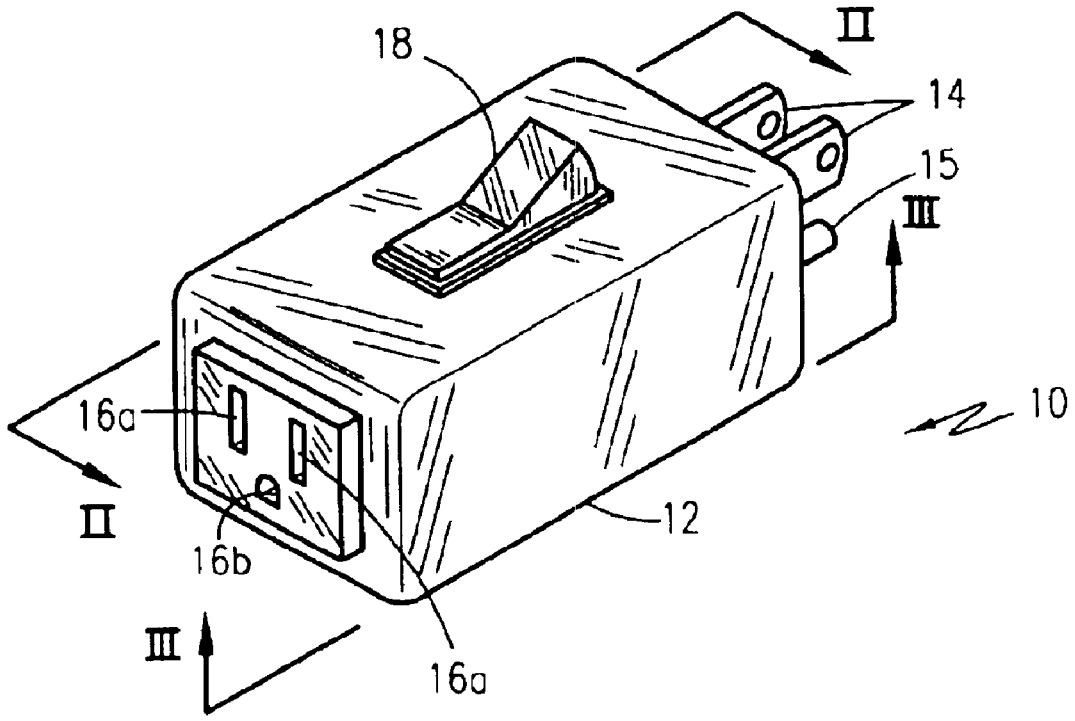
FIG. 1 is a perspective view of an electrical interrupt switch according to one preferred embodiment of the present invention.

Referring now to FIG. 1, an electrical interrupt switch 10 is shown, in accordance with a preferred embodiment of the present invention, and is provided to allow the disconnection of electrical plug-connected equipment without removing the plug from the receptacle. It is anticipated that such a switch 10 could be made available for use on grounded or ungrounded electrical systems. The switch 10 has a housing 12 that has a compact overall outer dimension approximately one inch high, one inch wide and three inches long. Extending outward from one end of the housing 12 are male blade connectors 14 sized for a standard 120 VAC plug that connect to common 120 VAC outlets found in homes and business. Additionally, a ground prong 15 could be made available depending on the model. Opposite the blade connectors 14 are corresponding receptacle connectors 16*a* to allow for the connection of a conventional electrical power cord. Accessible through the upper portion of the housing 12 is a rocker switch 18 that allows the user to open or close the electrical circuit in the manner described below.

Figure 2:
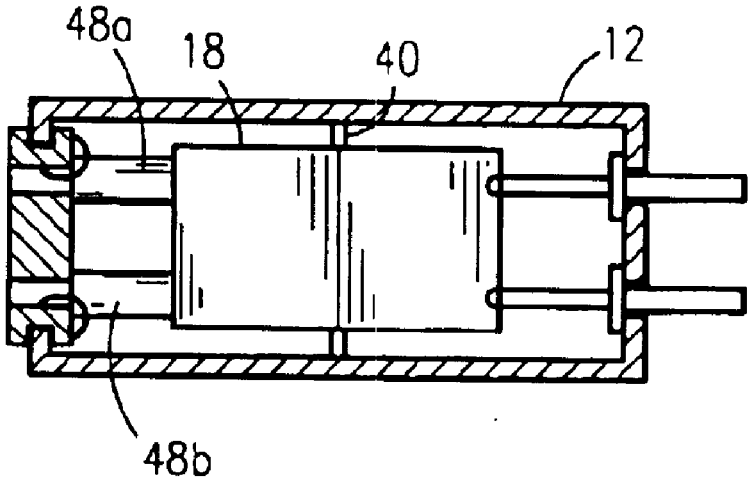
FIG. 2 is a cross sectional plan view thereof taken along line II—II of FIG. 1.
Figure 3:
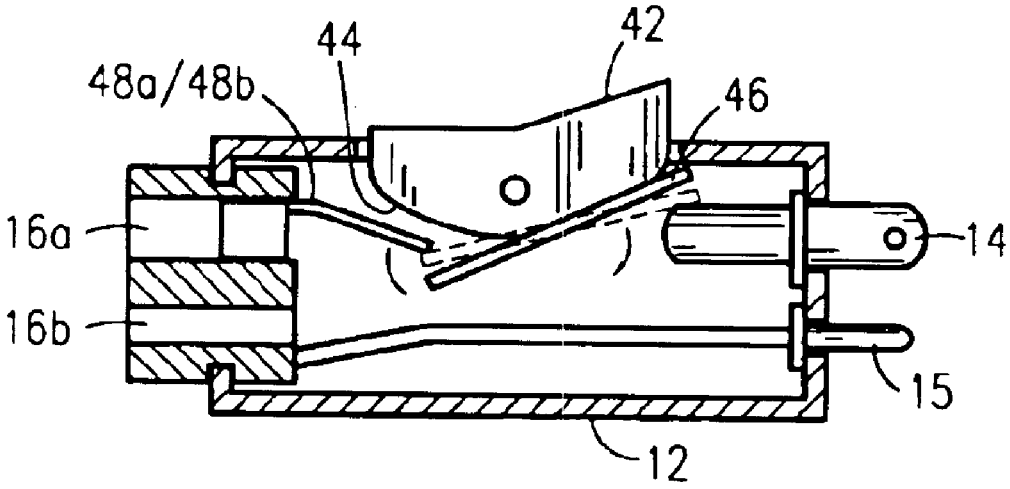
FIG. 3 is a cross sectional elevational view thereof taken along line III—III of FIG. 1.

Referring now to FIG. 2 and FIG. 3, the housing pivotally supports the rocker switch 18 about a pivoting axle 40. Having a pair of flat, intersecting touching surfaces 42 about the upper portion of the rocker switch 18, the lower portion is a cam-shaped arcuate body 44. A first electrically conductive contact 46 is supported along one side of the body 44. A second electrically conductive contact 48*a* is affixed to and in electrical communication with one receptacle connector 16*a*, and a third electrically conductive contact 48*b* is affixed at the same end and in electrical communication with the other receptacle connector 16*a*. The second and third electrically conductive contacts 48*a* and 48*b* each comprise a non-linear configuration, wherein a portion of each contact 48*a* and 48*b* projects downward from a horizontal portion of the respective contact 48*a* or 48*b* and away from the cam-shaped arcuate body 44 such that as the rocker switch 18 is articulated, the first electrical conductive contact 46 engages the blade connector 14 at one end and engages the second electrical conductive contact 48*a*, thereby creating electrical continuity between the receptacle connectors 16*a*, through the second contact 48*a* and third contact 48*b*, to the first contact 46 and to the blade connectors 14.

It is envisioned that parallel switching conductors of identical configuration are mounted about the body 44 such that each receptacle connector 16*a* is switched between electrical continuity to a respective blade connector 14.

Should an electrical interrupt switch 10 have a ground receptacle 16*b*, a ground prong 15 would be in continuous electrical communication therewith such that ground continuity is not effected by position or operation of the rocker switch 18.

As envisioned in the presented preferred embodiment, the electrical components of the invention would be made of copper and/or brass in a stamping process. The plastic enclosure would be made in an injection molding process.

2. Operation of the Preferred Embodiment

Figure 4:
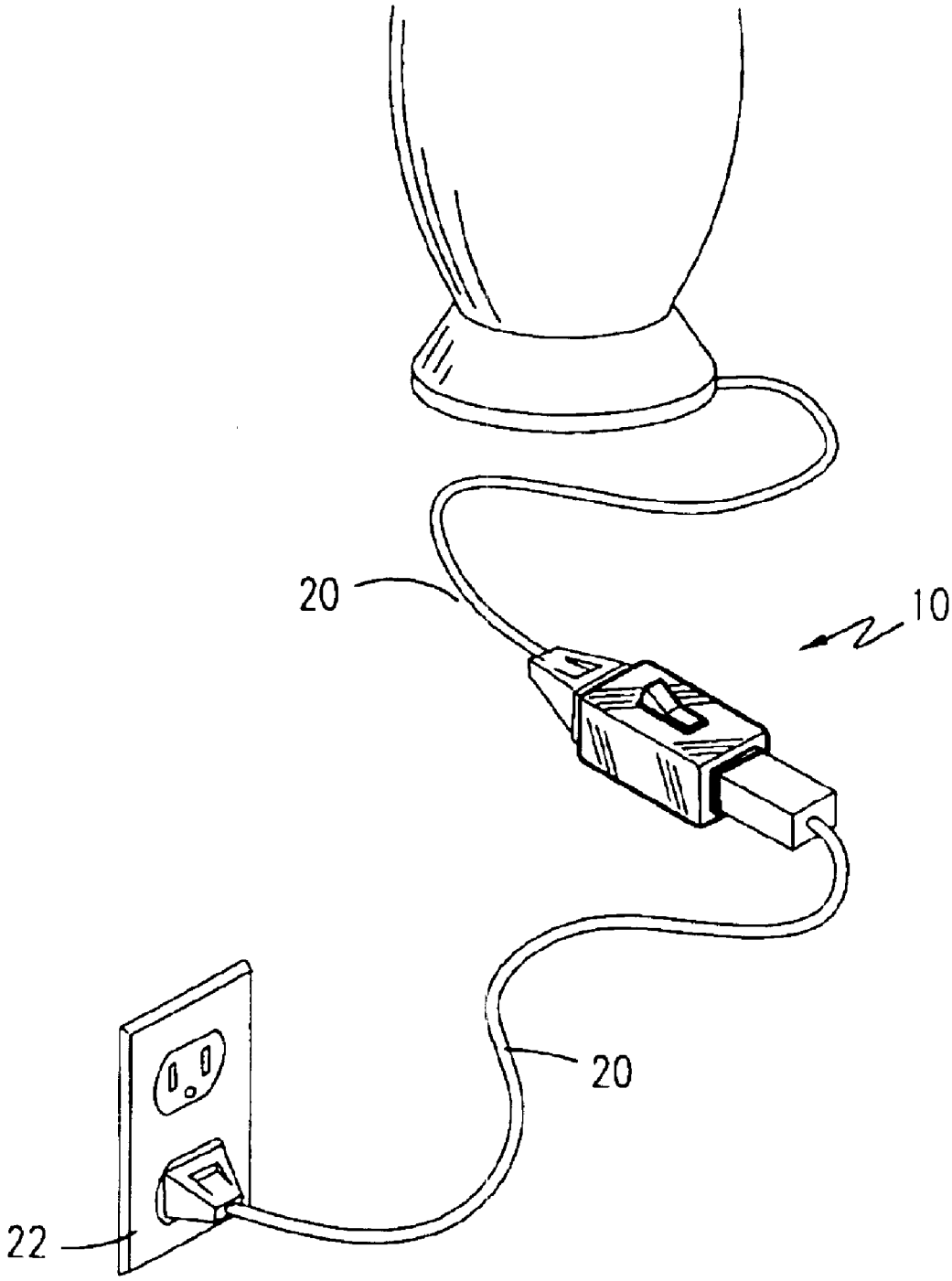
FIG. 4 is a perspective view of an electrical interrupt switch according to the present invention shown in use with a consumer appliance.

In operation as shown in FIG. 4, it is envisioned that the switch 10 would open both the hot and neutral connection while leaving the ground connection closed, if so equipped. The use would allow for the use of electrical disconnection of power cords 20 without actually physically removing the cord 20 from the receptacle 22.

The foregoing description is included to illustrate the operation of the preferred embodiment and is not meant to limit the scope of the invention. For other dedicated applications, many other configurations and uses are anticipated incorporating the present teachings. By way of example, and not as a limitation, uses such as integration with wiring harness, replacement of hard-wired relays, and incorporation into modular electrical equipment in the computer, aircraft, heavy machinery, electrical hand tool, and other industries can be made to incorporate the features and benefits foreseen herein. Therefore, the scope of the invention is to be limited only by the following claims.

What is claimed is:

1. An electrical interrupt switch comprising:

a housing having a first end opposite a second end and a top surface;

a pair of male blade connectors extending outward from said first end;

a ground prong extending outward from said first end;

female receptacle connectors penetrating said second end opposite said male blade connectors;

a ground receptacle in electrical communication with said ground prong;

switch means accessible through said top surface for allowing a user to open or close an electrical circuit between said male blade connectors and said female receptacle connectors, respectively, wherein said switch means comprises a rocker switch, and wherein said housing pivotally supports said rocker switch about a pivoting axle, thereby providing said rocker switch with angular movement for opening or closing said electrical circuit between conductive contacts;

wherein a lower portion of said rocker switch comprises a cam-shaped arcuate body; and wherein said conductive contacts comprise:

a first electrically conductive contact supported along a first side of said body;

a second electrically conductive contact having a first end opposite a second end, said first end in electrical communication with said receptacle connectors and said second end projects downward from a horizontal portion of said second electrically conductive contact and away from said cam-shaped arcuate body such that as said rocker switch is articulated, said first electrically conductive contact engages said blade connectors at one end and engages said second electrically conductive contact at an opposite end;

a third electrically conductive contact having a first end opposite a second end, said first end in electrical communication with one of said receptacle connectors and said second end projects downward from a horizontal portion of said third electrically conductive contact and away from said cam-shaped arcuate body such that as said rocker switch is articulated, said first electrically conductive contact engages said blade connectors at one end and engages said third electrically conductive contact at an opposite end;

articulation of said rocker switch causes electrical communication between said blade connectors, said first electrically conductive contact, said second electrically conductive contact and said third electrically conductive contact, thereby creating electrical continuity between said receptacle connector, through said second electrically conductive contact and said third electrically conductive contact, to said first electrically conductive contact and to said blade connector.

2. The electrical interrupt switch of claim 1, wherein parallel switching conductors of identical configuration are mounted about said body such that each said receptacle connector is switchable to electrical continuity of a respective blade connector.

* * * * *